United States Patent [19]

Wang

[11] Patent Number: 4,687,456

[45] Date of Patent: Aug. 18, 1987

[54] IRREGULAR MOTION TYPE FISH SHAPE DIVING TOY

[76] Inventor: Ming-Jeng Wang, P.O. Box 10780, Taipei, Taiwan

[21] Appl. No.: 821,533

[22] Filed: Jan. 23, 1986

[51] Int. Cl.[4] ..... A63H 23/14

[52] U.S. Cl. ..... 446/158

[58] Field of Search ..... 446/158, 156, 154, 153, 446/162, 161, 155

[56] References Cited

U.S. PATENT DOCUMENTS

| | | | |
|---|---|---|---|
| 1,399,855 | 12/1921 | Fierlein | 446/156 |
| 2,645,883 | 7/1953 | De Salvo | 446/158 |
| 3,628,286 | 12/1971 | Mashahiro | 446/158 |
| 4,135,326 | 1/1979 | Tong | 446/158 |

*Primary Examiner*—Mickey Yu

[57] ABSTRACT

This invention is a toy for diving swim, which possess a fish shape shell to form a water-proof space, the rear portion of the shell is a tail body made of flexible material and equipped with two separated tail fins; the interior of the fish shell has a battery, a motor, a power reduction, and diversion devide to drive a connect level which is coupled with the interior of the tail body such that the tail fins are actuated to swing against water up and down quickly and to make the toy swing forward by the reflective force, the interior of the belly portion of the toy has two sets of rollers at both sides which can move back and forth freely and irregularly in order to break the toy balance and make the toy dive along irregular path.

2 Claims, 10 Drawing Figures

IRREGULAR MOTION TYPE FISH SHAPE DIVING TOY

BACKGROUND OF THE INVENTION

This invention is a diving toy. There are some similar toys in the market such as the submarine shape toys. However, those toys can not provide very active motion and also lack interest essence. The conventional toys are equipped with propellers at tail seats of the toys which produce forward force to make toys move and also equipped rudders to change the diving direction. Furthermore, those toys with propellers have potential risk to hurt people.

In spite of any device changes of the conventional toys, they can not provide the vivid diving motion because all the portions of the toys are fixed including belly fins, back fins, and tail fins and the toy motion only depends on the propellers; if the change of the diving direction is desired, the lift rudder and direction rudder are required to be adjusted quite often so that the interest essence of the toys is reduced.

SUMMARY OF THE INVENTION

The primary objective of this invention is to provide a fish type diving toy which possesses tail motion.

The secondary objective of this invention is to provide a fish type diving toy which can give irregularly rolling diving.

Another objective of this invention is to provide a kind of belly fin which can regulate the angle to change the diving parth arc for the fish type diving toy.

And another objective of this invention is to provide a fish type diving toy which possesses water-proof property.

BRIEF DESCRIPTION OF THE DRAWINGS

The drawings attached explain the characteristic of the construction and the function of the invention.

DETAILED DESCRIPTION OF THE PREFERRED EMBODIMENTS

Figure 1:
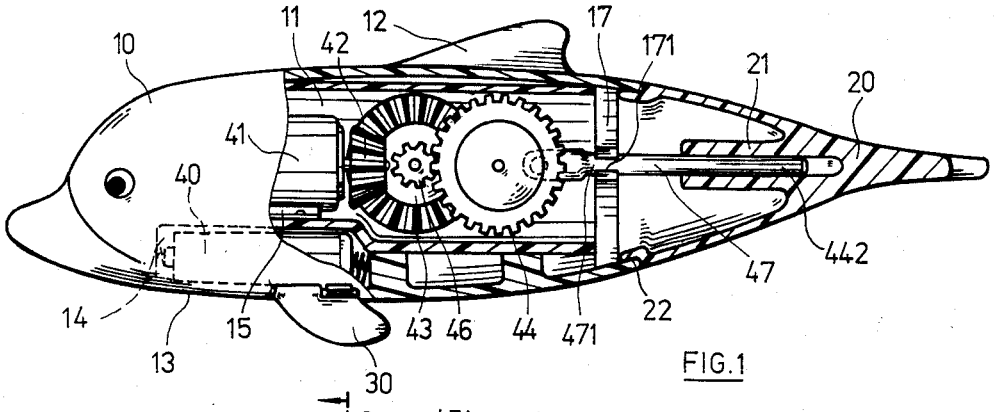
FIG. 1 is the front cut view of this invention.
Figure 2:
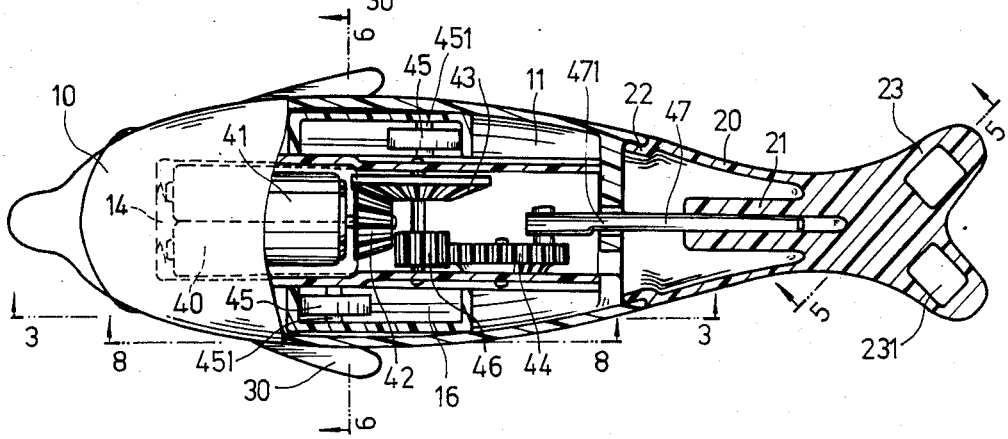
FIG. 2 is the portional top cut view of this invention.
Figure 3:
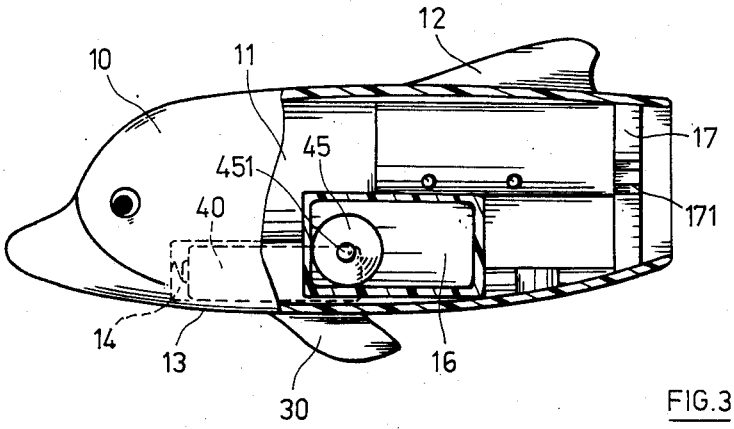
FIG. 3 is the sectional view taken along the line 3—3 of the FIG. 2 to show the roller and roller cabinet.
Figure 4:
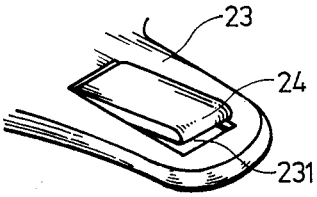
FIG. 4 is the cubic view of the portion of the tail fin of this invention.
Figure 5:
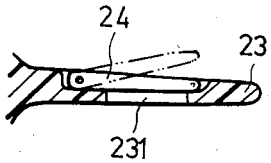
FIG. 5 is the portional side cut view of the tail fin of this invention to show the motion of the supplementary tail fin.

This invention consists of hollow head body 10 including head, chest, and belly which couples with a hollow tail body 20 made of soft and flexible rubber or equivalent material to form a water-proof space 11.

The head body 10 has a back fin 12 and a pair of angle adjustable belly fin 30. Accordingly to FIG. 1, belly 13 of head body 10 possesses a lifted up and suitable arc shape so that the toy of this invention has the tendacy to float upward during diving. The interior of head body 10 equips with a water-proof battery chamber 14, motor fix seat 15, roller cabinets 16 at both side of the waist portion, and a support bracket 17 which locates at the space of the tail body 20 and extends to the head body 10; the head body 10 is made of hard plastic or equivalent material in order to fix the above components installed in the internal space 11 and to keep the corresponding positions between each other. The mentioned water-proof battery chamber is used to enclose battery 40 tightly, the circuit of this battery 40 has a switch which appears outside the head body 10 so that the power source can be controlled from outside, this structure is a general device that is not necessary to make detailed description herein; the motor fix seat 15 is also a general device to fix the motor 41 which receives power from battery 40.

The output shaft of the motor 41 pivots with a drive gear 42 which clutches an umbrella shape gear 43 that is vertical to drive gear 42. This gear 43 actuates a penion coaxially; the motor speed is reduced to transmit outside to drive revolving drum 44, the side surface of the revolving drum is pivoted with a connecting level 47 eccentrically. The waist 471 of the connecting level 47 is supported on the support bracket 17 which is in the head body 10 and close to the tail body 20, the end side 442 of the level 47 is free end so that it can plug into the casing 21 of the tail body 20 loosely. The waist 471 of the connecting level 47 is smaller than the hole 171 of the support bracket 17 such that the connecting level 47 can slide back and forth in the hole 171 and can swing up and down because the hole 171 support it.

The front edge 22 of the tail body 20 plugs into the rear end of the head body 10 tightly. When the tail body 20 is subject to the actuation of connecting level 47 which swings up and down as fictitious line shows, the tail body can use the front edge 22 as a support point and then can bend up and down like swing motion to tap water for producing forward pushing force.

Both sides of the rear end of the tail body 20 have one separated tail fin 23 respectively which roughly keeps horizontal position. The center of each tail fin 23 has a hole 231 which has pivot hole to pivot with a supplementary tail fin 24 whose length is always greater than the size of the hole 231 and is covers on the hole 231 so that a valve which only allow to swing upward is formed. As the tail fin 23 bends downward, the supplementary tail fin 24 is subject to the water pressure to lift up and, therefore, reduces the resistance on the tail fin 23 to make tail fin 23 bend downward quickly. However, as the tail fin 23 bends upward, the supplementary tail fin 24 is subject to the water pressure to shut the hole 231 automatically, therefore, the tail fin 23 encounters higher resistance and slows the motion. Accordingly, the alternate swing motion to tap water can increase more interest essence and avoids monotony.

Figure 9:
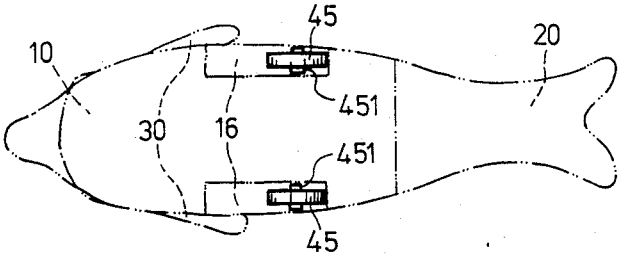
FIG. 9 is the portional top view of the roller.

Both sides of the waist of head body 10 have one rectangular shape roller cabinet 16 respectively. Each cabinet contains a roller 45. The cabinet 16 is designed to locate at the gravity center of this invention. In addition, the length of the roller cabinet 16 is greater than the diameter of the roller 45 so that the roller 45 can rolls back and forth inside the roller cabinet 16 and can roll to the vicinity of the mass balance point. When the rollers 45 at both sides, as shown in FIG. 9, roll to the rear region of the roller cabinet 16, the gravity center moves toward the tail body 20 so that the head body 10 lifts upward and makes the toy float upward in water; however, when the rollers 45 roll to the front region of the roller cabinet 16, the gravity center shifts forward and makes the toy dive into the water to some depth. At that point, the toy is subject to the compression by the water pressure and the influence of bended upward arc of the belly portion 13 and automatically floats upward gradually. If the left side roller 45 and right side roller 45 are not located at same region (front or rear region), as shown in FIG. 1, the gravity center of the toy will produce irregular inclination toward various directions such that the toy rolls or rotates irregularly during speedy movement.

The bottom surface of the above mentioned roller cabinet 16 slightly inclines forward such that as the toy moves forward horizontally the rollers 45 can roll to the front region of the roller cabinet 16 and let the gravity center shift forward and then makes the toy dive to the water automatically. Moreover, the roller 45 can possess stick 451 which bulge toward both sides so that the friction between roller 45 and the wall of roller cabinet 16 can be reduced, or the roller 45 is changed to be a spherical body for reducing friction.

Figure 6:
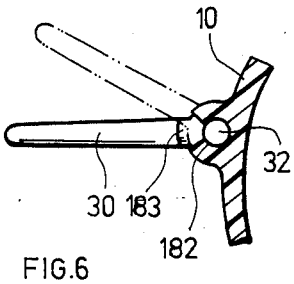
FIG. 6 is the portional sectional view taken along the line 6—6 of FIG. 2 to show the adjustability of the belly fin.
Figure 7:
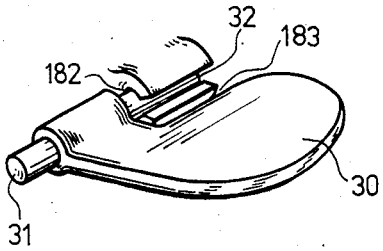
FIG. 7 is the portional cubic view of the belly fin of this invention.
Figure 8:
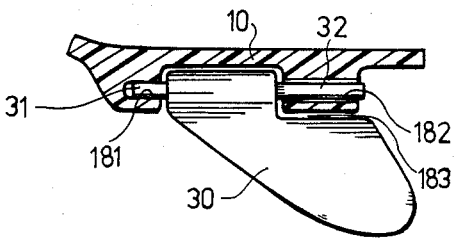
FIG. 8 is the sectional view taken along the line 8—8 of FIG. 2 to show the structure of the belly fin.
Figure 10:
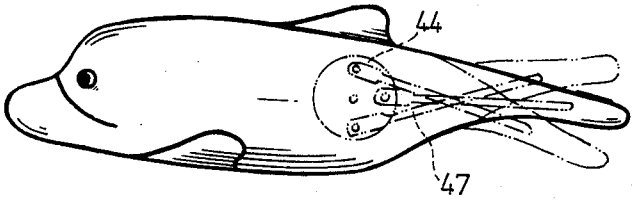
FIG. 10 is the front view to show the belly fin lifted upward and the motion of the tail fin.

Two sides of head body 10 have pivot holes 181 and open type axle hole 182 which belly fins 30 can plug in. The front end of the inner side of the belly fin 30 has a bulged axle 31 and the rear end has a tail axle 32, the portion between the tail axle 32 and the belly fin 30 has a slot which is slightly greater than the wall thickness of the axle hole seat 183 of the head body 10. The bulged axle 31 plugs into the pivot hole 181 of the head body 10 and the tail axle 32 plugs into the axle hole 182, the axles and holes contacts closely so that the belly fin 30, as shown in FIG. 6 or FIG. 10, adjusts up to some angle range, then it maintains this angle. Beyond that, the belly fins 30 and head body 10 are assembled by this way will let assembling work become easy. In addition, the belly fin 30 swings along the outer edge of the axle hole seat 183 so that the clearance between belly fins 30 and head body 10 can keep constant to increase the beautiful appearance of the toy.

The belly fins 30 which locate two sides of the head body 10 can be adjusted to symmetrical or asymmetrical angle such that the toy dives upward or downward. The toy can irregularly roll, turn right, or turn left. In addition to that, the above mentioned rollers 45 at both sides of waist portion change the gravity center frequently such that the toy in water can have a very irregular diving path.

This invention uses a simple structure to let the tail body 20 which is plugged into the rear end of the head body 10 bend up and down and tap water continuously so that the toy dives forward with an irregular path and the device gives the fish shape toy very vivid character. Furthermore, the tail body 20 is made of soft and flexible material so that the toy is very safe that is the advantage which the conventional propeller type toy can not have.

I claim:

1. A diving fish toy comprising:

(a) a hollow head body portion;

(b) a hollow flexible tail body portion connected to said head body portion forming a closed space therein;

(c) a battery chamber formed in said closed space for holding batteries;

(d) a propulsion means in said closed space for propelling said fish toy through water, comprising: an electric motor operatively connected to a revolving drum through a gear set, and a connect lever having one end pivoted eccentrically to said drum;

(e) a pair of roller cabinets, each located at a respective side of the center of gravity of said toy, each cabinet further being elongated and extending from said head body portion toward said tail body portion and having one end ahead of the center of gravity and a second end behind the center of gravity;

(f) a pair of rollers, each located in a respective roller cabinet for changing the center of gravity of said fish toy so as to cause said fish toy to move in an irregular pattern;

(g) a support bracket located in said head body portion for supporting an intermediate portion of said connect lever;

(h) a casing means inside said tail body portion for connecting said tail body portion with a second end of said connect lever;

(i) a pair of tail fins integral with said tail body portion, each having a hole and a pivotable supplementary fin therein, said supplementary fin opening said hole as said tail fin moves in one direction and closing said hole as siad tail fin moves in a second direction; and (j) circuit means including a switch for electrically connecting said motor to said batteries when said batteries are positioned in said battery chamber, whereby when said fish toy is placed in water and said switch is turned on said motor drives said gear set, said revolving drum and said connect lever, said connect lever privoting at said support bracket causing said tail body to flex and propell said fish toy through said water.

2. A toy according to claim 1, wherein said rollers are each in a spherical shape.

* * * * *